US006557775B1

(12) United States Patent
Brinson et al.

(10) Patent No.: US 6,557,775 B1
(45) Date of Patent: May 6, 2003

(54) DOLLY TRACK

(76) Inventors: John Dillard Brinson, 1443 Crown Street, Vancouver, British Columbia (CA), V7J 1G4; Gil Forrester, 157 April Road, Port Moody, British Columbia (CA), V3H 3M4

( * ) Notice: Subject to any disclaimer, the term of this patent is extended or adjusted under 35 U.S.C. 154(b) by 0 days.

(21) Appl. No.: 09/989,618

(22) Filed: Nov. 20, 2001

(51) Int. Cl.[7] ..... E01B 23/00

(52) U.S. Cl. ..... 238/10 R; 238/27; 238/32; 238/134; 238/143; 238/148; 238/243; 238/255

(58) Field of Search ..... 238/10 R, 13, 238/10 A, 10 E, 10 F, 27, 32, 50, 51, 143, 134, 135, 148, 260, 252, 255, 256, 151, 216, 217, 220, 238, 243, 245, 254; 191/22 DM

(56) References Cited

U.S. PATENT DOCUMENTS

| | | | | | |
|---|---|---|---|---|---|
| 245,876 | A | * | 8/1881 | Schroeder | 238/10 R |
| 831,942 | A | * | 9/1906 | Fenwick | 191/22 DM |
| 1,003,330 | A | * | 9/1911 | Ezsan | 238/50 |
| 1,281,451 | A | * | 10/1918 | Whitcraft | 238/50 |
| 1,374,804 | A | * | 4/1921 | Bakovich | 238/10 R |
| 1,914,531 | A | * | 6/1933 | Rosenthal | 238/10 R |
| 4,989,782 | A | | 2/1991 | McKie | |
| 5,251,732 | A | * | 10/1993 | Bruning | 191/22 DM |
| D376,460 | S | | 12/1996 | Isaia et al. | |
| 5,711,227 | A | | 1/1998 | Johnson | |
| D401,951 | S | | 12/1998 | Spielberg et al. | |
| 5,887,787 | A | | 3/1999 | Saldana, III | |
| D409,348 | S | | 5/1999 | McKie | |

FOREIGN PATENT DOCUMENTS

| | | |
|---|---|---|
| EP | 0 384 069 B1 | 8/1993 |
| WO | WO99/41455 | 8/1999 |

* cited by examiner

*Primary Examiner*—Mark T. Le
(74) *Attorney, Agent, or Firm*—Greer, Burns & Crain, Ltd.

(57) ABSTRACT

A portable, folding camera dolly track is assembled from a number of folding track sections, each track section having a parallel pair of rails, each rail having a base and a cylindrical wheel-supporting rail element, and a transverse spacer. A continuous, removable, resilient cap is provided on each wheel-supporting rail element to provide a smooth ride over joints formed by adjoining rail elements.

13 Claims, 7 Drawing Sheets

44
16
44
12

44
16
44
11

44
16
14
16
6
10
13
44
6

DOLLY TRACK

TECHNICAL FIELD

The invention relates to railed tracks for supporting and transporting wheeled vehicles, and more particularly, but not exclusively, to portable tracks for camera dollies.

BACKGROUND

In motion picture, video and television production, smooth camera movement is achieved using a wheeled camera support platform referred to as a dolly, which typically runs on two parallel dolly tracks or rails. The tracks or rails provide a solid fixed path for the wheeled dolly to follow to thereby provide a precise, smooth moving camera shot. When filming on location, away from the studio, portable dolly tracks must be used.

In existing portable dolly tracks, there are typically provided a number of removably connected track sections, each having two tubular parallel rail sections pivotally joined by transverse spreaders. See for example U.S. Pat. No. 5,887,787 Saldana. The rails are supported on the spreaders, which pivot to permit folding. When unfolded, latches or fasteners extend between two adjacent spreaders between the rails and are tightened to maintain the rails in parallel relation.

Since the rails span the space between adjacent spreaders in existing portable dolly tracks, there can be a sag in the rail as the heavy dolly rolls over it, causing undesirable vertical movement in the camera shot. Also the location of the latches between the rails can interfere with movement of the wiring and cables connected to the camera as the dolly rolls and can interfere with the feet of the dolly operator or focus puller. Further, the metal surface of the rails can become dented or pitted which may harm a smooth camera shot. Consequently there is a need for a portable, collapsible dolly track which avoids the foregoing problems.

SUMMARY OF INVENTION

The present invention therefore provides a folding track section for a wheeled vehicle, comprising: i) a parallel pair of rails, each rail having a horizontal base, an upper cylindrical wheel-supporting rail element, and a vertically extending element joining the base and the upper wheel-supporting rail element; ii) male and female joining elements in the ends of the rails; iii) a transverse spacer element extending between and pivotally secured at each end to the rails further provided on each rail element with a removable, resilient cap and wherein the upper wheel-supporting element is configured to prevent the cap from rotation about its length-wise axis.

The present invention further provides a folding track section for a wheeled vehicle, comprising: i) a parallel pair of rails each rail having a horizontal base, an upper cylindrical wheel-supporting rail element, and a vertically extending element joining the base and the upper wheel-supporting rail element wherein the vertical element is provided with an aperture adjacent one end; ii) male and female joining elements in the ends of the rails; iii) a transverse spacer element extending between and pivotally secured at each end to the rails; and iv) a latch member secured to the rail and having a hooked end for engaging an aperture in the vertical member of an adjoining section.

The present invention further provides a folding track section for a wheeled vehicle, comprising: i) a parallel pair of rails, each rail having a horizontal base, an upper cylindrical wheel-supporting rail element, and a vertically extending element joining the base and the upper wheel-supporting rail element; ii) male and female joining elements in the ends of the rails; iii) a transverse spacer element extending between and pivotally secured at each end to the rails through a vertical pivot axis on the base element; wherein the vertical pivot axis comprises a horizontal support extending from and secured to the vertical element.

BRIEF DESCRIPTION OF DRAWINGS

In drawings which illustrate a preferred embodiment of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figures 1A, 1B, 1C:
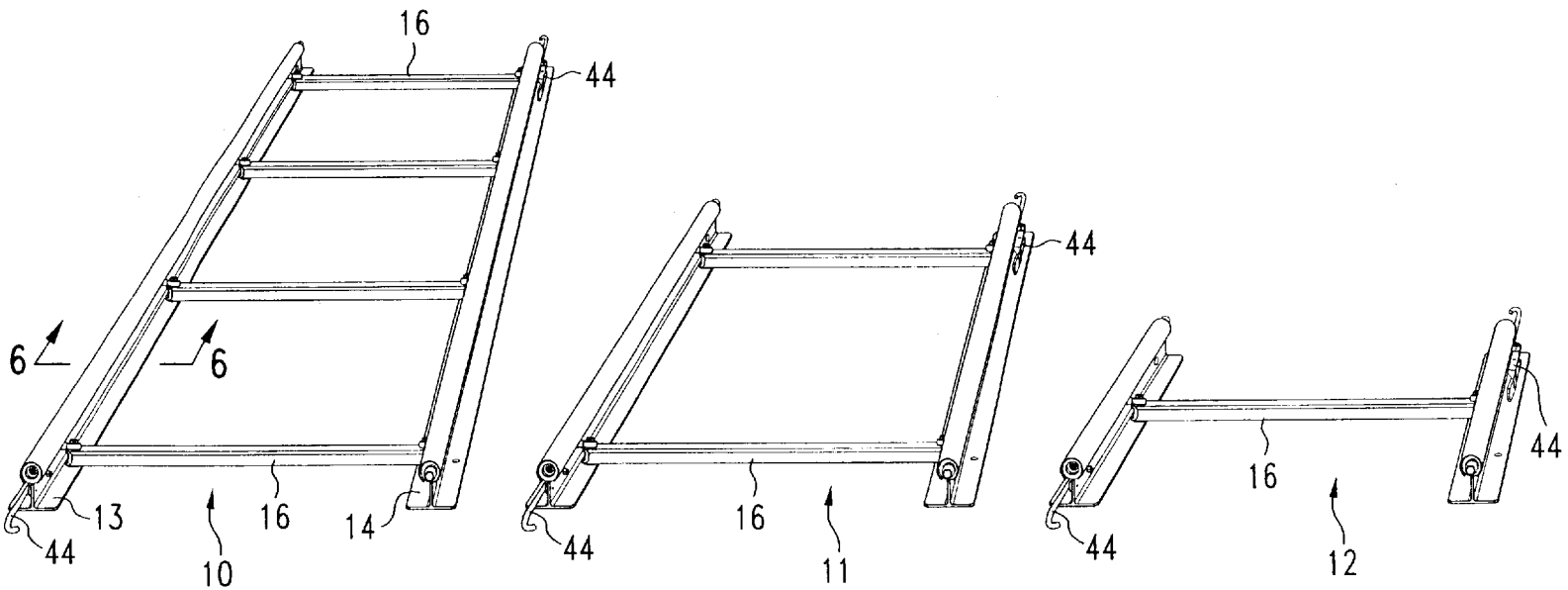
FIGS. 1A, 1B and 1C are perspective views of a dolly track section according to the invention in 8-foot, 4-foot and 2-foot sections respectively.
Figure 2:
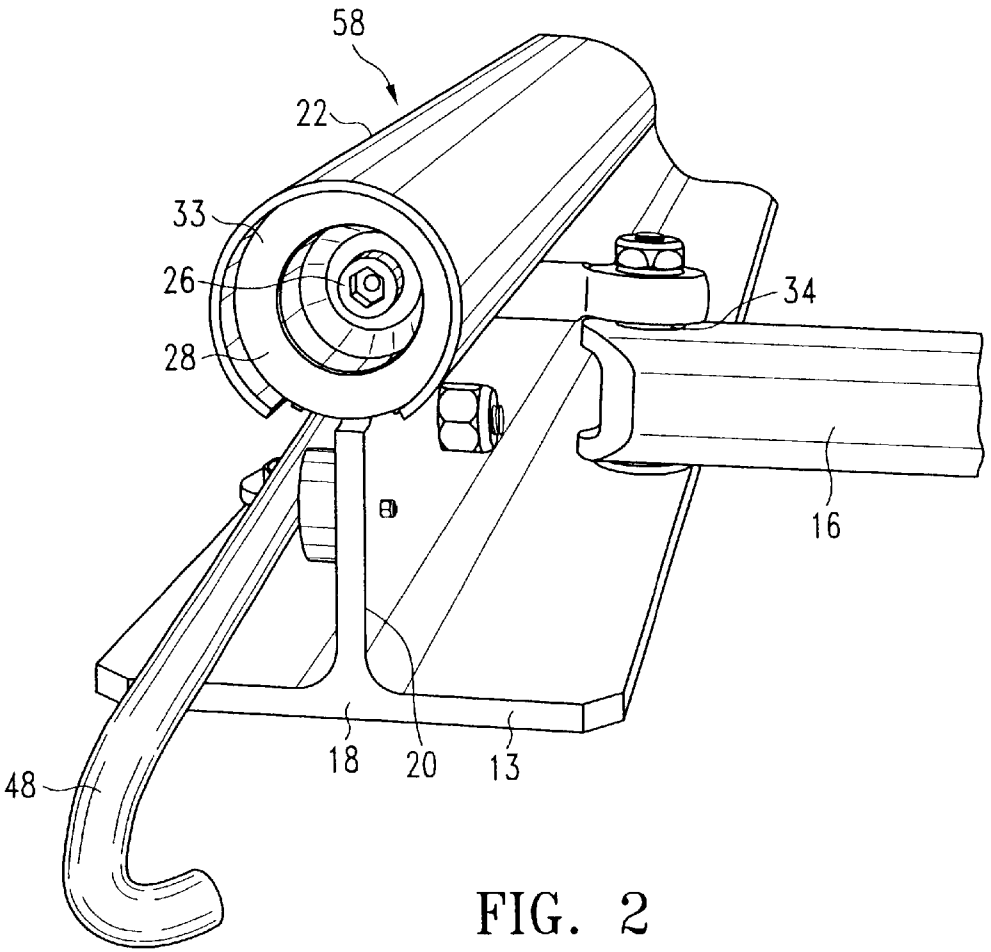
FIG. 2 is an end perspective view of the track section shown in FIG. 1, in detail.
Figure 3:
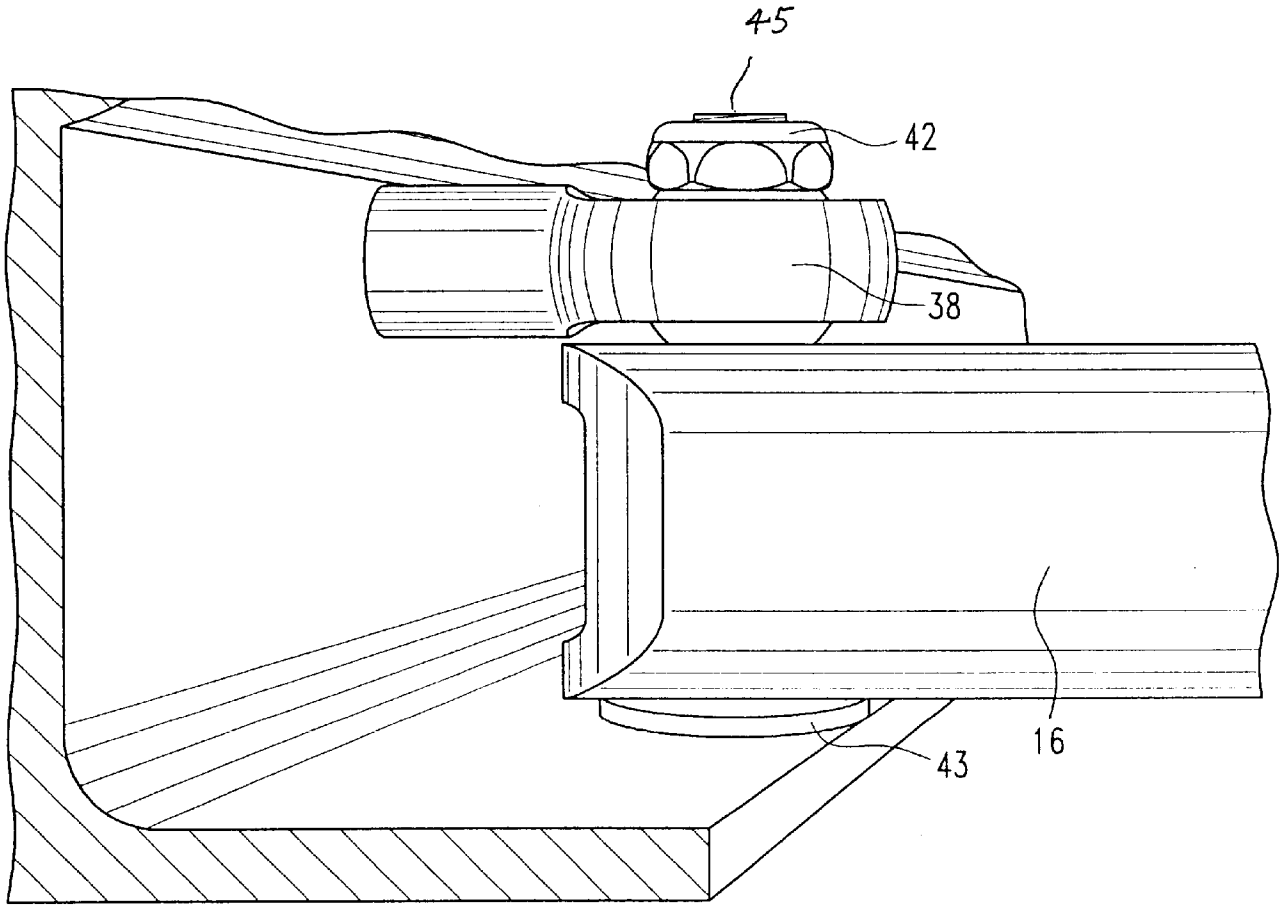
FIG. 3 is a detail of the spreader connection for the track section shown in FIG. 1.
Figure 4:
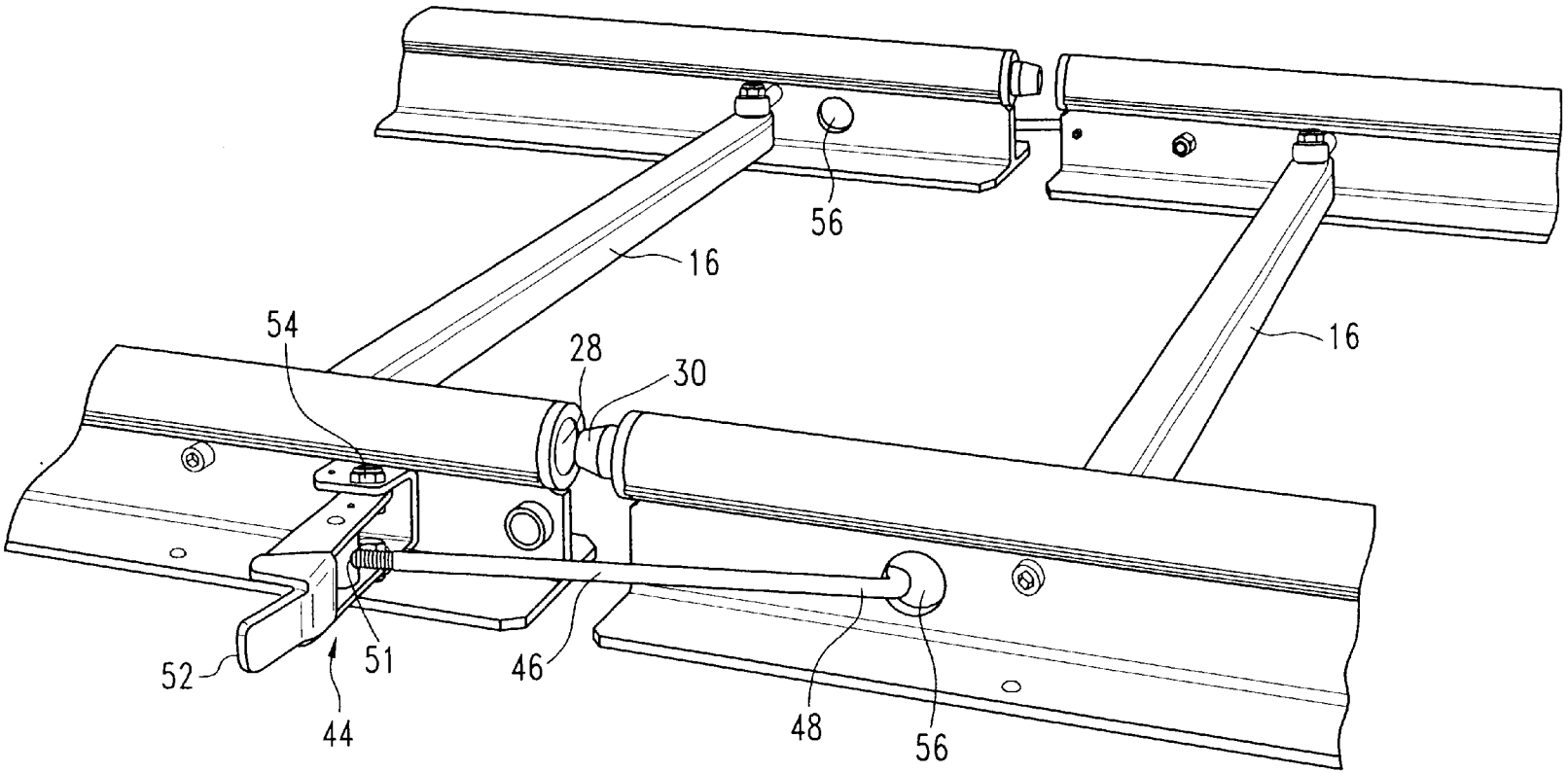
FIG. 4 is a side perspective view of the invention, with protective cap removed for purposes of illustration, illustrating a connection of two track sections.

With reference to FIG. 1, an 8-foot track section 10 is shown having parallel rails 13, 14 and transverse spreaders 16. While an 8-foot section preferably has four spreaders 16 spaced at equal intervals, 4-foot section 11 having two spreaders 16 and 2-foot section 12 having a single spreader 16 are also used to permit combinations of sections having the desired length. The sections of different lengths are otherwise identically constructed.

Figure 8:
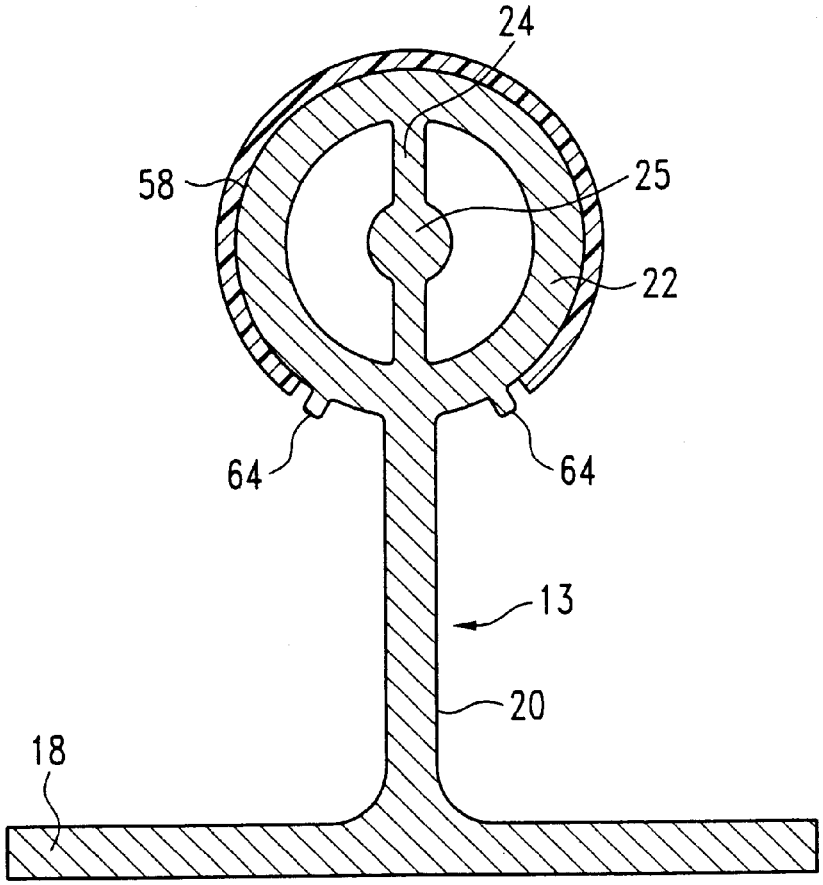
FIG. 8 is a cross-section taken along lines 6—6 of FIG. 1.
Figure 7B:
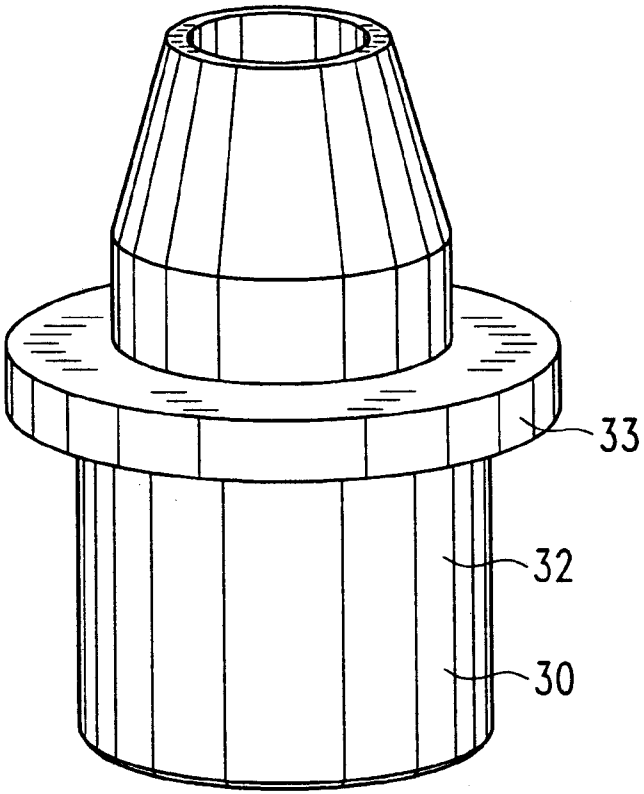
FIGS. 7A and 7B are perspective views of the male and female end pieces.
Figure 7A:
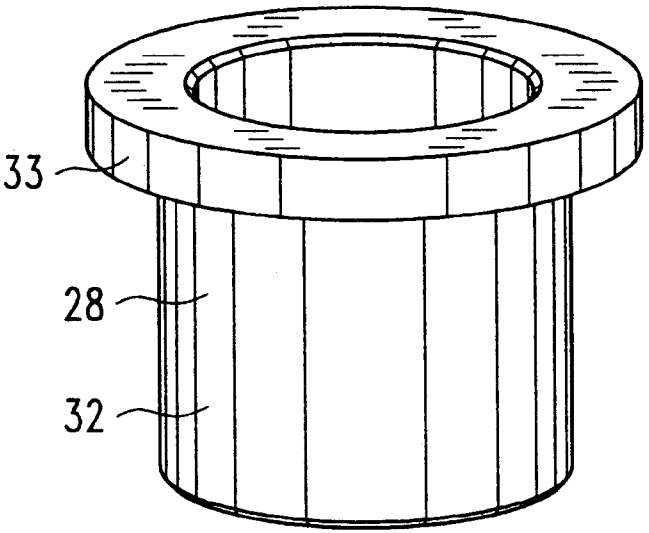

As shown in FIG. 8, rails 13, 14 are formed of anodized extruded aluminum and have a lower horizontal base 18, a vertical element 20 and a tubular member 22. The rails are formed of aluminum which is anodized black to reduce reflection from lighting. The tubular member 22 has a vertical cross-member 24 for strengthening and rigidity. Cross-member 24 has a central widening 25, circular in cross-section, to receive a screw 26 to secure the end pieces 28, 30. End pieces 28, 30 are stainless steel. There are female end pieces 28 which receive corresponding male end piece 30 on the adjoining track element. The cross-members 24 are drilled out of the ends of the tubular members 22 to a depth equal to the depth of the extensions 32 beyond collars 33 of the end pieces 28, 30 so that the end pieces can be slid into the tubular members and secured to the cross-members by screws 26. Preferably the same ends of rails 13, 14 of one track section will have complementary end pieces, that is, one will be male and one female.

Spreaders 16 are lengths of aluminum tubing which are pivotally secured at either end by pivot connections 34. A rod end bearing 38, or other horizontally extending support is secured to vertical element 20 by a screw 40. Nut 42 is screwed onto a threaded bolt 45 which extends through base 18. Friction-reducing 30 washers 43, made of Teflon or the like, facilitate the pivoting of the spreaders 16.

Figure 5:
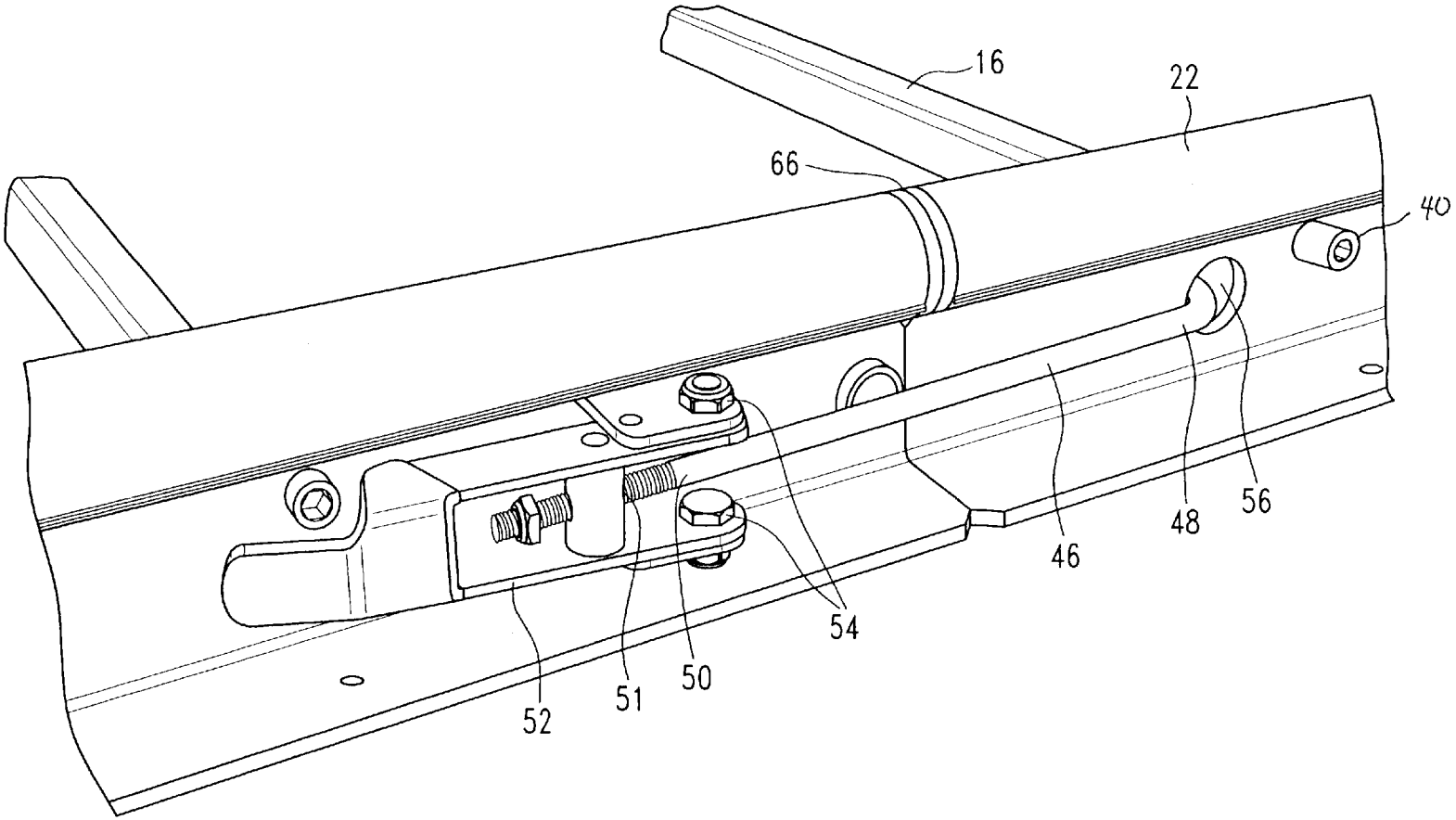
FIG. 5 is a side perspective view of the invention with protective cap removed showing two joined track sections.

Latch members 44 are provided at opposite ends of rails 13, 14 and comprise a hooked bar 46 having hooked end 48 and opposite end 50 which is pivotally secured at 51 to handle 52, which in turn has one end pivotally secured at 54 in an over-center relationship so that when adjacent rail sections are connected as in FIG. 5, and hooked end 48 is placed through hole 56 in vertical element 20, the pivoting of handle 52 causes the two sections to be drawn tightly and securely together, and handle 52 is biased in the closed position shown in FIG. 5 until force is applied to pivotally release it.

Figure 6:
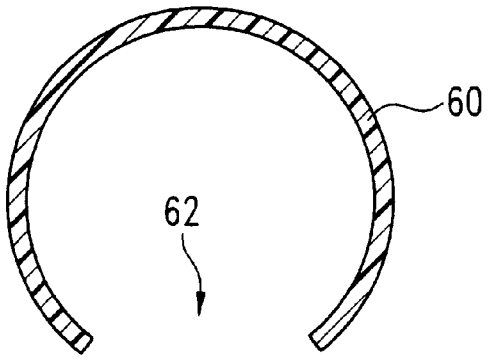
FIG. 6 is cross-section view of the plastic cap.

To provide protection for the upper surface 58 of the rails and a smoother motion for the dolly wheels, a plastic cap 60 is snapped onto the tubular section 22. It is shown in section in FIG. 6. Preferably it is molded of high density polyvinyl chloride (PVC) of a thickness about 0.07 inches so that it is flexible to bend over the track and is open along arc 62 to receive the track. It is preferably provided in 2-foot, 4-foot, 8-foot or 16-foot lengths. The extruded tubular member 22 has lengthwise ribs 64 which prevent cap 60 from rolling over the side of tubular member 22. The cap is preferably positioned so that the joints between cap sections do not overlie the joints between the track sections.

In operation, each track section is folded for transportation by pivoting the spreaders 16 so that rails 13, 14 come into close parallel contact. At the desired location, the desired number and length of track sections are unfolded, and secured end to end using latch members 44. The appropriate length of plastic cap 60 is then snapped onto the upper surface 58 of the rails. Preferably the cap 60 extends over the joints 66 between adjacent sections.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A portable track for wheeled camera dollies comprising:

a) a plurality of folding track sections, each said track section comprising:

i) a parallel pair of rails, each rail having a horizontally-extending base, a cylindrical wheel-supporting rail element, and a vertically extending element joining the base and the upper wheel-supporting rail element;

ii) male and female elements provided respectively in opposite ends of each wheel-supporting rail element for engaging the complementary element of an adjoining wheel-supporting rail element;

iii) a transverse spacer element extending between and pivotally secured at its respective ends to opposed ones of said parallel pair of rails;

iv) means for releasably securing adjoining track sections; and b) a continuous, removable, resilient cap associated with each wheel-supporting rail element, each said continuous, removable, resilient cap formed of one or more cap sections whereby a joint formed by adjoining ones of said cap sections does not overly a joint formed by adjoining wheel-supporting rail elements, and wherein each said wheel-supporting element is configured to prevent said cap from rotation about its lengthwise axis when said cap is installed on said wheel-supporting element.

2. The portable track for wheeled camera dollies of claim 1 wherein said continuous, removable, resilient cap is "C"-shaped in cross-section, and each said wheel-supporting element is configured to prevent said cap from rotation about its lengthwise axis by comprising two longitudinally extending ribs which extend between the ends of said "C" when said cap is installed on said wheel-supporting element.

3. The portable track for wheeled camera dollies of claim 2 wherein said cap is formed of polyvinyl chloride.

4. The portable track for wheeled camera dollies of claim 1 wherein each said vertically extending element of each of said rails is provided with an aperture adjacent one end;

and further comprising iv) a latch member secured to said each said rail and having a hooked end for engaging an aperture in the vertical member of an adjoining section.

5. The portable track for wheeled camera dollies of claim 4 wherein said latch member comprises a handle, one end of said handle being pivotally connected to said rail in an over-center relationship so that when adjacent rail sections are connected and said hooked end is placed through said aperture in said vertical element, the pivoting of said handle causes said adjacent sections to be drawn tightly and securely together, and said handle is biased in a closed position.

6. The portable track for wheeled camera dollies of claim 1 wherein said transverse spacer element is pivotally secured at its respective ends to opposed ones of said parallel pair of rails by vertically extending pivot pins extending upwardly from and secured at their lower ends to each said base element and secured at their upper ends to pivot pin supporting means extending horizontally from and secured to said vertically extending elements.

7. The portable track for wheeled camera dollies of claim 6 wherein said horizontally extending pivot pin supporting means comprises a rod end bearing secured at one end thereof to said vertical element.

8. The portable track for wheeled camera dollies of claim 7 wherein each said vertically extending element of each of said rails is provided with an aperture adjacent one end;

and further comprising iv) a latch member secured to said each said rail and having a hooked end for engaging an aperture in the vertical member of an adjoining section.

9. The portable track for wheeled camera dollies of claim 8 wherein said latch member comprises a handle, one end of said handle being pivotally connected to said rail in an over-center relationship so that when adjacent track sections are connected and said hooked end is placed through said aperture in said vertical element, the pivoting of said handle causes said adjacent sections to be drawn tightly and securely together, and said handle is biased in a closed position.

10. A folding track section for assembling a portable track for wheeled camera dollies, said track section comprising:

i) a parallel pair of rails, each rail having a horizontally-extending base, a cylindrical wheel-supporting rail element, and a vertically extending element joining the base and the upper wheel-supporting rail element;

ii) male and female elements provided respectively in opposite ends of each wheel-supporting rail element for engaging the complementary element of an adjoining wheel-supporting rail element; iii) a transverse spacer element extending between and pivotally secured at its respective ends to opposed ones of said parallel pair of rails by vertically extending pivot pins extending upwardly from and secured at their lower ends to each said base element and secured at their upper ends to pivot pin supporting means extending horizontally from and secured to said vertically extending elements.

11. The folding track section of claim 10 wherein said horizontally extending pivot pin supporting means comprises a rod end bearing secured at one end thereof to said vertically extending element.

12. The folding track section of claim 10 wherein each said vertically extending element of each of said rails is provided with an aperture adjacent one end; and further comprising iv) a latch member secured to said each said rail and having a hooked end for engaging an aperture in the vertical member of an adjoining section.

13. The folding track section of claim 12 wherein said latch member comprises a handle, one end of said handle being pivotally connected to said rail in an over-center relationship so that when adjacent track sections are connected and said hooked end is placed through said aperture in said vertically extending element, pivoting of said handle causes said adjacent sections to be drawn tightly and securely together, and said handle is biased in a closed position.

* * * * *